US010174975B2

(12) United States Patent
Feng et al.

(10) Patent No.: US 10,174,975 B2
(45) Date of Patent: Jan. 8, 2019

(54) TWO-PHASE REFRIGERATION SYSTEM

(71) Applicant: Carrier Corporation, Farmington, CT (US)

(72) Inventors: Yinshan Feng, South Windsor, CT (US); Jinliang Wang, Ellington, CT (US); Futao Zhao, Farmington, CT (US); Thomas D. Radcliff, Vernon, CT (US); Parmesh Verma, South Windsor, CT (US)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 15/029,743

(22) PCT Filed: Aug. 14, 2014

(86) PCT No.: PCT/US2014/051031

§ 371 (c)(1),
(2) Date: Apr. 15, 2016

(87) PCT Pub. No.: WO2015/057299

PCT Pub. Date: Apr. 23, 2015

(65) Prior Publication Data

US 2016/0245558 A1 Aug. 25, 2016

Related U.S. Application Data

(60) Provisional application No. 61/892,157, filed on Oct. 17, 2013.

(51) Int. Cl.
*F25B 25/00* (2006.01)
*F25B 9/00* (2006.01)
(Continued)

(52) U.S. Cl.
CPC ..... *F25B 25/005* (2013.01); *F25B 9/002* (2013.01); *F25B 9/008* (2013.01); *F25B 23/006* (2013.01);
(Continued)

(58) Field of Classification Search
CPC ..... H02P 25/00; F25B 25/005; F25B 41/00; F25B 9/002; F25B 9/008; F25B 23/006;
(Continued)

(56) References Cited

U.S. PATENT DOCUMENTS 4,096,706 A 6/1978 Beckwith
4,419,865 A 12/1983 Szymaszek
(Continued)

FOREIGN PATENT DOCUMENTS

CN 1732365 A 2/2006
CN 1774605 A 5/2006
(Continued)

OTHER PUBLICATIONS

White Paper: Revisiting Flammable Refrigerants; Thomas Blewitt, Director of Primary Designated Engineers, Underwriters Laboratories at Thomas.V.Blewitt@us.ul.com.*
(Continued)

*Primary Examiner* — Len Tran
*Assistant Examiner* — Gordon Jones
(74) *Attorney, Agent, or Firm* — Cantor Colburn LLP

(57) ABSTRACT

A heat transfer system includes a first two-phase heat transfer fluid vapor/compression circulation loop including a compressor, a heat exchanger condenser, an expansion device, and a heat absorption side of a heat exchanger evaporator/condenser. A first conduit in a closed fluid circulation loop circulates a first heat transfer fluid therethrough. A second two-phase heat transfer fluid circulation loop transfers heat to the first heat transfer fluid circulation
(Continued)

loop through the heat exchanger evaporator/condenser, including a heat rejection side of the heat exchanger evaporator/condenser, a liquid pump, a liquid refrigerant reservoir located upstream of the liquid pump and downstream of the heat exchanger evaporator/condenser, and a heat exchanger evaporator. A second conduit in a closed fluid circulation loop circulates a second heat transfer fluid therethrough having an ASHRAE Class A toxicity and a Class 1 or 2L flammability rating.

14 Claims, 1 Drawing Sheet

(51) Int. Cl.

| | |
|---|---|
| ***F25B 23/00*** | (2006.01) |
| ***F25B 41/00*** | (2006.01) |
| ***F25B 39/00*** | (2006.01) |
| ***F25B 40/02*** | (2006.01) |
| ***F25B 49/02*** | (2006.01) |

(52) U.S. Cl.
CPC ..... *F25B 39/00* (2013.01); *F25B 40/02* (2013.01); *F25B 41/00* (2013.01); *F25B 49/022* (2013.01); *F25B 2400/12* (2013.01); *F25B 2400/121* (2013.01); *F25B 2500/03* (2013.01)

(58) Field of Classification Search
CPC ..... F25B 39/00; F25B 40/02; F25B 49/022; F25B 2400/12; F25B 2400/121; F25B 2500/03
See application file for complete search history.

(56) References Cited

U.S. PATENT DOCUMENTS

| | | | | |
|---|---|---|---|---|
| 4,599,873 | A | 7/1986 | Hyde | |
| 5,692,387 | A | 12/1997 | Alsenz et al. | |
| 5,752,390 | A | 5/1998 | Hyde | |
| 6,058,719 | A * | 5/2000 | Cochran | F25B 49/005 62/129 |
| 6,076,367 | A | 6/2000 | Sandofsky et al. | |
| 6,145,332 | A | 11/2000 | Hyde | |
| 6,370,893 | B1 | 4/2002 | Gupte et al. | |
| 7,178,358 | B2 | 2/2007 | Inaba et al. | |
| 7,992,397 | B2 | 8/2011 | Nemoto et al. | |
| 8,261,565 | B2 | 9/2012 | Borror et al. | |
| 8,484,984 | B2 | 7/2013 | Spearing | |
| 2005/0120737 | A1 | 6/2005 | Borror et al. | |
| 2007/0234753 | A1 * | 10/2007 | Nemoto | F25B 25/005 62/335 |
| 2009/0013716 | A1 * | 1/2009 | Spearing | F25B 25/005 62/527 |
| 2010/0031697 | A1 * | 2/2010 | Hinde | F25B 7/00 62/498 |
| 2010/0326129 | A1 * | 12/2010 | Moriwaki | C09K 5/045 62/498 |
| 2011/0289953 | A1 * | 12/2011 | Alston | B60H 1/32 62/238.6 |
| 2013/0098088 | A1 | 4/2013 | Lin et al. | |
| 2013/0186126 | A1 * | 7/2013 | Morimoto | F25B 13/00 62/324.6 |
| 2014/0047855 | A1 * | 2/2014 | Kolarich | F25B 49/02 62/129 |
| 2014/0137582 | A1 * | 5/2014 | Louvar | F25B 25/005 62/119 |
| 2014/0260404 | A1 * | 9/2014 | Verma | F25B 9/008 62/333 |

FOREIGN PATENT DOCUMENTS

| | | | |
|---|---|---|---|
| CN | 102679638 | A | 9/2012 |
| JP | 2007155315 | A | 6/2007 |
| WO | 2009009164 | A1 | 1/2009 |
| WO | 2011014784 | A2 | 2/2011 |
| WO | 2012096078 | A1 | 7/2012 |
| WO | 2013049344 | A2 | 4/2013 |

OTHER PUBLICATIONS

Refrigeration System Performance using Liquid-Suction Heat Exchangers; S. A. Klein, D. T. Reindl, and K. Brownell College of Engineering University of Wisconsin—Madison; Published in the International Journal of Refrigeration, vol. 23, Part 8, pp. 588-596 (2000).*

Notification of Transmittal of the International Search Report and the Written Opinion of the International Searching Authority, or the Declaration; Appplication No. PCT/US2014/051031; dated Nov. 19, 2014; 11 pages.

Chinese Office Action Issued in CN Application No. 201480069383.6, dated Jan. 19, 2018, 7 pages.

* cited by examiner

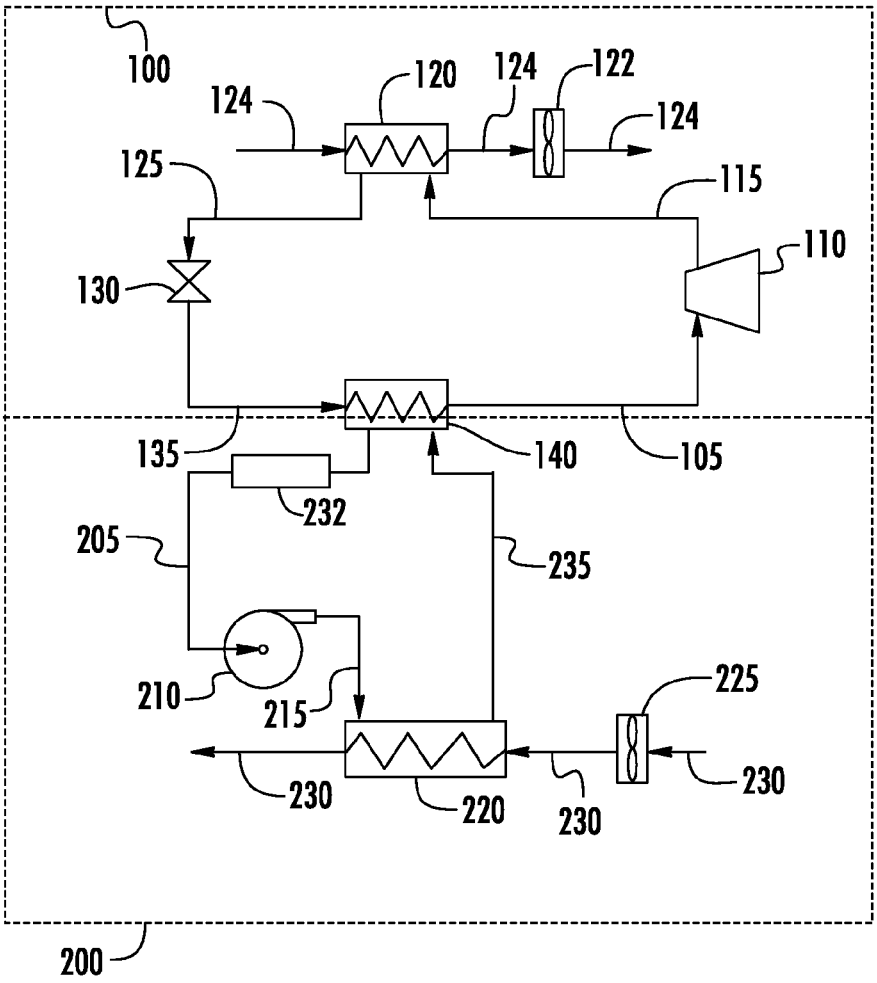
100
124
120
124
122
124
125
115
110
130
135
140
105
232
205
235
210
215
225
230
230
220
230
200

TWO-PHASE REFRIGERATION SYSTEM

FEDERAL RESEARCH STATEMENT

This invention was made with government support under contract number DE-EE0003955 awarded by the Department of Energy. The government has certain rights in the invention.

BACKGROUND OF THE INVENTION

The subject invention relates to refrigeration systems. More particularly, the subject invention relates to cascade air conditioning systems with a two-phase refrigerant loop.

Refrigerant systems are known in the HVAC&R (heating, ventilation, air conditioning and refrigeration) art, and operate to compress and circulate a heat transfer fluid throughout a closed-loop heat transfer fluid circuit connecting a plurality of components, to transfer heat away from a secondary fluid to be delivered to a climate-controlled space. In a basic refrigerant system, heat transfer fluid is compressed in a compressor from a lower to a higher pressure and delivered to a downstream heat rejection heat exchanger, commonly referred to as a condenser for applications where the fluid is sub-critical and the heat rejection heat exchanger also serves to condense heat transfer fluid from a gas state to a liquid state. From the heat rejection heat exchanger, where heat is typically transferred from the heat transfer fluid to ambient environment, high-pressure heat transfer fluid flows to an expansion device where it is expanded to a lower pressure and temperature and then is routed to an evaporator, where heat transfer fluid cools a secondary fluid to be delivered to the conditioned environment. From the evaporator, heat transfer fluid is returned to the compressor. One common example of refrigerant systems is an air conditioning system, which operates to condition (cool and often dehumidify) air to be delivered into a climate-controlled zone or space. Other examples may include heat pumps and refrigeration systems for various applications requiring refrigerated environments.

Historically, conventional HFC and HCFC heat transfer fluids such as R22, R123, R407C, R134a, R410A and R404A, have been utilized in heating, air conditioning, and refrigeration applications. Recently, however, concerns about global warming and, in some cases, ozone depletion, have created a need for alternative heat transfer fluids. In some cases, the use of natural heat transfer fluids such as R744 ($CO_2$), R718 (water), or R717 (ammonia) has been proposed. The various known and proposed heat transfer fluids each have their own advantages and disadvantages. For example, $CO_2$ as a heat transfer fluid offers zero ozone depletion potential and low global warming potential compared to many hydrocarbon-based heat transfer fluids. However, many proposed systems having $CO_2$ as a heat transfer fluid require the $CO_2$ to be maintained in a supercritical fluid state, which can add to equipment and operating complexity and cost. For example, in many systems, the $CO_2$ is subcooled, or cooled below its saturation temperature, upstream of a pump inlet between about 1.5 and 3 degrees Fahrenheit to force complete phase change of the $CO_2$ to liquid. To reduce power consumption of the system, subcooling at the pump inlet can be eliminated, but vapor entrained in the $CO_2$ fluid stream causes cavitation in the pump and therefore instability of the pump operation.

BRIEF DESCRIPTION

In one embodiment, a heat transfer system includes a first two-phase heat transfer fluid vapor/compression circulation loop including a compressor, a heat exchanger condenser, an expansion device, and a heat absorption side of a heat exchanger evaporator/condenser. A first conduit in a closed fluid circulation loop circulates a first heat transfer fluid therethrough. The system further includes second two-phase heat transfer fluid circulation loop that transfers heat to the first heat transfer fluid circulation loop through the heat exchanger evaporator/condenser, including a heat rejection side of the heat exchanger evaporator/condenser, a liquid pump, a liquid refrigerant reservoir located upstream of the liquid pump and downstream of the heat exchanger evaporator/condenser, and a heat exchanger evaporator. A second conduit in a closed fluid circulation loop circulates a second heat transfer fluid therethrough. The second heat transfer fluid has an ASHRAE Class A toxicity rating and an ASHRAE Class 1 or 2L flammability rating, and a liquid pump inlet subcooling is between 0° C. and 10° C.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawing in which:

The FIGURE is a block schematic diagram depicting an embodiment of a heat transfer system having primary and secondary heat transfer fluid circulation loops.

DETAILED DESCRIPTION

An exemplary heat transfer system with first and second heat transfer fluid circulation loop is shown in block diagram form in the FIGURE. As shown, a fluid pumping device, such as a compressor 110, in first fluid circulation loop 100 pressurizes a first heat transfer fluid in its gaseous state, which both heats the fluid and provides pressure to circulate it throughout the system. The hot pressurized gaseous heat transfer fluid exiting from the compressor 110 flows through conduit 115 to heat exchanger condenser 120, which functions as a heat exchanger to transfer heat from the heat transfer fluid to the surrounding environment, such as to air blown by fan 122 through conduit 124 across the heat exchanger condenser 120. The hot heat transfer fluid condenses in the condenser 120 to a pressurized moderate temperature liquid. The liquid heat transfer fluid exiting from the condenser 120 flows through conduit 125 to a flow metering device, such as expansion device 130, where the pressure is reduced. The reduced pressure liquid heat transfer fluid exiting the expansion device 130 flows through conduit 135 to the heat absorption side of heat exchanger evaporator/condenser 140, which functions as a heat exchanger to absorb heat from a second heat transfer fluid in secondary fluid circulation loop 200, and vaporize the first heat transfer fluid to produce heat transfer fluid in its gas state to feed the compressor 110 through conduit 105, thus completing the first fluid circulation loop.

A second heat transfer fluid in second fluid circulation loop 200 transfers heat from the heat rejection side of heat exchanger evaporator/condenser 140 to the first heat transfer fluid on the heat absorption side of the heat exchanger 140, and the second heat transfer fluid vapor is condensed in the process to form second heat transfer fluid in its liquid state. The liquid second heat transfer fluid exits the heat exchanger evaporator/condenser 140 and flows through conduit 205 as a feed stream for liquid pump 210. The liquid second heat transfer fluid exits pump 210 at a higher pressure than the pump inlet pressure and flows through conduit 215 to heat exchanger evaporator 220, where heat is transferred to air blown by fan 225 through conduit 230. Liquid second heat transfer fluid vaporizes in heat exchanger evaporator 220, and gaseous second heat transfer fluid exits the heat exchanger evaporator 220 and flows through conduit 235 to the heat rejection side of heat exchanger evaporator/condenser 140, where it condenses and transfers heat to the first heat transfer fluid in the primary fluid circulation loop 100, thus completing the second fluid circulation loop 200.

To prevent cavitation and operational instability at the liquid pump 210, a liquid second heat transfer fluid reservoir, for example, a receiver 232, is located along conduit 215 between the heat exchanger evaporator/condenser 140 and the liquid pump 210. At the receiver 232, the second heat transfer fluid is condensed to liquid state without subcooling, or in some embodiments minimal subcooling, defined as subcooling between 0-10 degrees Celsius, the volume of the receiver 232 prevents vapor entrance into the liquid pump 210 thus eliminating cavitation of the liquid pump 210. In other embodiments, the amount of subcooling is between 0-5 degrees Celsius, 0-3 degrees Celsius or between 0-2 degrees Celsius. In yet other embodiments, the amount of subcooling is zero. Control of the liquid pump 210 speed is based on a heat exchanger evaporator 220 outlet superheat level. Using receiver 232 as an alternative to subcooling the second heat transfer fluid reduces power consumption of the system, in some embodiments by between 1% and 2% annually.

In an additional exemplary embodiment, the second fluid circulation loop 200 may include multiple heat exchanger evaporators (and accompanying fans) disposed in parallel in the fluid circulation loop. This may be accomplished by including a header (not shown) in conduit 215 to distribute the second heat transfer fluid output from pump 210 in parallel to a plurality of conduits, each leading to a different heat exchanger evaporator (not shown). The output of each heat exchanger evaporator would feed into another header (not shown), which would feed into conduit 235. Such a system with multiple parallel heat exchanger evaporators can provide heat transfer from a number of locations throughout an indoor environment without requiring a separate outdoor fluid distribution loop for each indoor unit, which cannot be readily achieved using indoor loops based on conventional 2-phase variable refrigerant flow systems that require an expansion device for each evaporator. A similar configuration can optionally be employed in the first fluid circulation loop 100 to include multiple heat exchanger condensers (and accompanying fans and expansion devices) disposed in parallel in the fluid circulation loop, with a header (not shown) in conduit 115 distributing the first heat transfer fluid in parallel to a plurality of conduits each leading to a different heat exchanger condenser and expansion device (not shown), and a header (not shown) in conduit 135 to recombine the parallel fluid flow paths. When multiple heat exchanger condensers are used, the number of heat exchanger condensers and expansion devices would generally be fewer than the number of heat exchanger evaporators.

The first heat transfer fluid circulation loop utilizes heat transfer fluids that are not restricted in terms of flammability and/or toxicity, and this loop is a substantially outdoor loop. The second heat transfer fluid circulation loop utilizes heat transfer fluids that meet certain flammability and toxicity requirements, and this loop is substantially an indoor loop. By substantially outdoor, it is understood that a majority if not all of the loop is outdoors, but that portions of the substantially outdoor first loop may be indoors and that portions of the substantially indoor second loop may be outdoors. In an exemplary embodiment, any indoor portion of the outdoor loop is isolated in a sealed fashion from other protected portions of the indoors so that any leak of the first heat transfer fluid will not escape to protected portions of the indoor structure. In another exemplary embodiment, all of the substantially outdoor loop and components thereof is located outdoors. By at least partially indoor, it is understood that at least a portion of the loop and components thereof is indoors, although some components such as the liquid pump 210 and/or the heat exchanger evaporator condenser 140 may be located outdoors.

The at least partially indoor loop can be used to exchange heat from an indoor location that is remote from exterior walls of a building and has more stringent requirements for flammability and toxicity of the heat transfer fluid. The substantially outdoor loop can be used to exchange heat between the indoor loop and the outside environment, and can utilize a heat transfer fluid chosen to provide the outdoor loop with thermodynamic that work efficiently while meeting targets for global warming potential and ozone depleting potential. The placement of portions of the substantially outdoor loop indoors, or portions of the indoor loop outdoors will depend in part on the placement and configuration of the heat exchanger evaporator/condenser, where the two loops come into thermal contact. In an exemplary embodiment where the heat exchanger evaporator/condenser is outdoors, then portions of conduits 205 and/or 235 of the second loop will extend through an exterior building wall to connect with the outdoor heat exchanger evaporator/condenser 140. In an exemplary embodiment where the heat exchanger evaporator/condenser 140 is indoors, then portions of conduits 105 and/or 135 of the first substantially outdoor loop will extend through an exterior building wall to connect with the indoor heat exchanger evaporator/condenser 140. In such an embodiment where portions of the first loop extend indoors, then an enclosure vented to the outside may be provided for the heat exchanger evaporator/condenser 140 and the indoor-extending portions of conduits 105 and/or 135. In another exemplary embodiment, the heat exchanger evaporator/condenser 140 may be integrated with an exterior wall so that neither of the fluid circulation loops will cross outside of their primary (indoor or outdoor) areas.

The heat transfer fluid used in the first fluid circulation loop has a critical temperature of greater than or equal to 31.2° C., more specifically greater than or equal to 35° C., which helps enable it to maintain two phases under normal operating conditions. Exemplary heat transfer fluids for use in the first fluid circulation loop include but are not limited to saturated hydrocarbons (e.g., propane, isobutane), unsaturated hydrocarbons (e.g., propene), R32, R152a, ammonia, an R1234 isomer (e.g., R1234yf, R1234ze, R1234zf), R410a, and mixtures comprising one or more of the foregoing.

The heat transfer fluid used in the second fluid circulation loop has an ASHRAE Class A toxicity rating and an ASHRAE Class 1 or 2L flammability rating, or their ISO 817 equivalents. Exemplary heat transfer fluids for use in the second fluid circulation loop include but are not limited to sub-critical fluid $CO_2$, a mixture comprising an R1234 isomer (e.g., R1234yf, R1234ze) and an R134 isomer (e.g., R134a, R134) or R32, 2-phase water, or mixtures comprising one or more of the foregoing. In another exemplary embodiment, the second heat transfer fluid comprises at least 25 wt %, and more specifically at least 50 wt % sub-critical fluid $CO_2$. In yet another exemplary embodiment, the second heat transfer fluid comprises nanoparticles to provide enhanced thermal conductivity. Exemplary nanoparticles include, but are not limited to, particles having a particle size less than 500 nm (more specifically less than 200 nm). In an exemplary embodiment, the nanoparticles have a specific heat greater than that of the second fluid. In yet another exemplary embodiment, the nanoparticles have a thermal conductivity greater than that of the second fluid. In further exemplary embodiments, the nanoparticles have a specific heat greater than at least 5 J/mol·K (more specifically at least 20 J/mol·K), and/or a thermal conductivity of at least 0.5 W/m·K (more specifically at least 1 W/m·K). In another exemplary embodiment, the second heat transfer fluid comprises greater than 0 wt % and less than or equal to 10 wt % nanoparticles, more specifically from 0.01 to 5 wt % nanoparticles. Exemplary nanoparticles include but are not limited to carbon nanotubes and metal or metalloid oxides such as $Si_2O_3$, CuO, or $Al_2O_3$.

The expansion device used in the first heat transfer fluid circulation loop may be any sort of known thermal expansion device, including a simple orifice or a thermal expansion valve (TXV) or an electronically controllable expansion valve (EXV). Expansion valves can be controlled to control superheating at the outlet of the heat absorption side of the heat exchanger evaporator/condenser and optimize system performance. Such devices and their operation are well-known in the art and do not require additional detailed explanation herein.

The heat exchangers used as the heat exchanger condenser 120, the heat exchanger evaporator/condenser 140, and the heat exchanger evaporator 220 may be any sort of conventional heat exchanger such as a shell and tube heat exchanger. Such heat exchangers are well-known in the art and do not require detailed explanation herein. In an exemplary embodiment, one or more of the heat exchanger condenser 120 and/or the heat exchanger evaporator 220 is a compact heat exchanger such as a microchannel heat exchanger. Microchannel heat exchangers can provide high heat transfer levels with reduced required quantities of heat transfer fluid. Exemplary useful microchannel heat exchangers can have individual tube diameters of less than 2 mm, more specifically less than 1.5 mm. In another exemplary embodiment, the heat exchanger evaporator/condenser 140 is a brazed plate heat exchanger. Such heat exchangers are well-known in the art, and represent a variant on the traditional shell and tube heat exchanger where the plates are disposed inside the shell. Plates are assembled together with brazing (or alternatively welding) along the periphery thereof, creating fluid flow channels between adjacent plates, with heat transfer occurring across the plate(s). Raised corrugations on interior surfaces of adjacent plates may also be brazed together to provide a circuitous pathway for fluid flow within the fluid channel. The plates have holes therein to provide fluid inlets and outlets, configured to direct fluid flow into the appropriate flow channels.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat transfer system, comprising:

a first heat transfer fluid circulation loop including:

a fluid pumping device;

a heat exchanger condenser configured to reject heat from a first heat transfer fluid flowing therethrough;

a flow metering device; and a heat exchanger evaporator/condenser configured to absorb thermal energy into the first heat transfer fluid;

wherein a first conduit in a closed fluid circulation loop circulates the first heat transfer fluid therethrough; and a second two-phase heat transfer fluid circulation loop configured to exchange heat with the first heat transfer fluid circulation loop through the heat exchanger evaporator/condenser, including:

a liquid pump;

a heat exchanger evaporator configured to evaporate a second heat transfer fluid via a thermal energy exchange with an airflow urged across the heat exchanger evaporator; and a receiver disposed between the heat exchanger evaporator/condenser and the liquid pump, the receiver configured to condense the second heat transfer fluid to a liquid state without subcooling;

wherein a second conduit in a closed fluid circulation loop circulates the second heat transfer fluid through the heat exchanger evaporator/condenser, the receiver, the liquid pump, and the heat exchanger evaporator, the second heat transfer fluid having an ASHRAE Class A toxicity rating and an ASHRAE Class 1 or 2L flammability rating or their ISO 817 equivalents.

2. The heat transfer system of claim 1, wherein the first fluid circulation loop is disposed at least partially outdoors.

3. The heat transfer system of claim 1, wherein the second fluid circulation loop is disposed at least partially indoors.

4. The heat transfer system of claim 1, wherein the first heat transfer fluid has a critical temperature of greater than or equal to 31.2° C.

5. The heat transfer system of claim 1, wherein the fluid pumping device in the first fluid circulation loop is variable-speed.

6. The heat transfer system of claim 1, wherein the liquid pump in the second fluid circulation loop is a variable speed pump.

7. The heat transfer system of claim 6, wherein a speed of the liquid pump is determined by a heat exchanger evaporator superheat level of the second circulation loop.

8. The heat transfer system of claim 1, wherein the first fluid circulation loop further comprises an expansion device.

9. The heat transfer system of claim 1, wherein the first heat transfer fluid comprises a saturated hydrocarbon.

10. The heat transfer system of claim 1, wherein the first heat transfer fluid comprises propane, propene, isobutane, R32, R152a, ammonia, an R1234 isomer, or R410a.

11. The heat transfer system of claim 1, wherein the second heat transfer fluid comprises a mixture comprising an R1234 isomer and an R134 isomer or R32, or 2-phase water.

12. The heat transfer system of claim 1, wherein the second heat transfer fluid comprises sub-critical fluid $CO_2$.

13. The heat transfer system of claim 3, wherein the liquid pump is disposed outdoors.

14. The heat transfer system of claim 2, wherein the heat exchanger evaporator/condenser is disposed outdoors.

* * * * *